US005251836A

United States Patent [19]

Pack

[11] Patent Number: 5,251,836

[45] Date of Patent: Oct. 12, 1993

[54] WINDING MACHINE FOR THE SELECTIVE WINDING OF CORES IN OPPOSITE SENSES

[75] Inventor: Klaus Pack, Wiehl, Fed. Rep. of Germany

[73] Assignee: Stahlkontor Maschinenbau GmbH, Hemeln, Fed. Rep. of Germany

[21] Appl. No.: 833,439

[22] Filed: Feb. 7, 1992

[30] Foreign Application Priority Data

Feb. 11, 1991 [DE] Fed. Rep. of Germany ..... 4104082

[51] Int. Cl.[5] ..... B65H 19/26; B65H 19/28

[52] U.S. Cl. ..... 242/56 A; 242/56 B; 242/65

[58] Field of Search ..... 242/56 A, 56 B, 56.2, 242/56.3, 56.6, 65

[56] References Cited

U.S. PATENT DOCUMENTS

| | | | |
|---|---|---|---|
| 2,585,226 | 2/1952 | Christman | 242/56.6 |
| 3,592,403 | 7/1971 | Schmidt . | |
| 3,752,412 | 8/1973 | Byrt | 242/56 A |
| 4,095,754 | 6/1978 | Campo | 242/65 |
| 4,111,377 | 9/1978 | Tetro et al. | 242/65 |
| 4,117,986 | 10/1978 | Hutzenlaub | 242/65 |
| 4,171,780 | 10/1979 | Bugnone | 242/56 A |
| 4,541,583 | 9/1985 | Forman et al. | 242/56 A |
| 4,728,050 | 3/1988 | Lüttle et al. | 242/56 A |
| 4,993,652 | 2/1991 | Moeller | 242/56 A |

FOREIGN PATENT DOCUMENTS

| | | |
|---|---|---|
| 132390 | 1/1985 | European Pat. Off. . |
| 1162157 | 1/1964 | Fed. Rep. of Germany . |
| 2127128 | 6/1971 | Fed. Rep. of Germany . |

*Primary Examiner*—William A. Cuchlinski, Jr.
*Assistant Examiner*—C. W. Fulton
*Attorney, Agent, or Firm*—Herbert Dubno

[57] ABSTRACT

A winding machine has its winding cores entrained in a swing circle on a turret from and to a winding location at which a pair of oppositely driven rollers can cooperate with the core to wrap a web on the latter selectively in opposite senses. A swing arm or pair of swing arms engages the web from opposite sides to sever the web and wrap the free end of the severed web onto the core in the respective sense.

10 Claims, 5 Drawing Sheets

WINDING MACHINE FOR THE SELECTIVE WINDING OF CORES IN OPPOSITE SENSES

FIELD OF THE INVENTION

My present invention relates to a winding machine in which winding cores or sleeves for rolls of web material can be wound with the web in opposite senses selectively. More particularly, the invention relates to a multiple coil winding machine in which two or more cores are displaceable in a swing circle on a turret so that each empty core is positioned at a winding location and then carried along the circle away from the winding location while a new empty core can be positioned at this location, and at least one swing arm is provided to assist in the application of the web in one or the other sense to the core to allow one or the other side of the web to be selectively turned inwardly or outwardly on the roll being wound.

BACKGROUND OF THE INVENTION

In the winding of rolls of a web material, depending upon the material characteristics and/or previous production or rerolling requirements, printed or coated webs may have to be wound so that one or the other side is turned inwardly or outwardly in the roll being wound on a winding sleeve or core.

In the European Patent Document EP A2 0 132 390, for example, a turret winding machine is described in which the cores are carried upon a turret and an empty core is positioned at a winding location and displaced therefrom as a roll is wound thereon. A swing arm can engage the web between the roll and the winding location from one side or an opposite side to apply the cut end of the web to the empty core in one or the opposite sense, thereby selectively enabling the roll to be wound with one or the other side turned inwardly or outwardly as required. The swing arm here is mounted on a turret to enable it in one position to swing from above and in another position to swing from below into engagement with the web.

One of the problems with this system, apart from the complexity of the swing arm assembly, is that the web must be fed to the winding location over different guide rollers depending upon the direction in which it is to be wound on the core and, consequently, considerable service time is required to set up a machine for a change in the winding direction, significant lengths of web may be wasted, and the interruption in production may be for significant durations.

OBJECTS OF THE INVENTION

It is, therefore, the principal object of the present invention to provide an improved winding machine capable of selectively winding a web on a winding core or sleeve so that one or the other side of the web is turned inwardly or outwardly in the roll being wound, whereby drawbacks of the earlier system are avoided.

Another object of this invention is to provide an improved winding machine for the purposes described which is structurally simple and can allow switchover in the sense of winding within relatively brief period and without significant manual efforts or interruption of the web feed.

SUMMARY OF THE INVENTION

These objects and others which will become apparent hereinafter by providing upstream of the winding location at which the empty winding core or sleeve is positioned, a pair of counterrotating rollers which are disposed on opposite sides of the web so that these rollers can be shifted by pivoting the pair about an axis to selectively dispose one or the other roller of the pair opposite the empty core to allow application of the web by the roll of the pair which serves as the contact roller onto the core in one or the other sense. The swingable roller pair cooperates with swing arm means including at least one swing arm so that the swing arm will engage the web in one direction or the other, depending upon the sense of rotation of the contact roller, to apply the cut end of the web to the empty core. In general, the swing arm swings in the same sense as the core is rotated by the contact roller or in the sense opposite the sense in which the contact roller is rotated to apply the web to the empty core.

According to the invention, therefore, a winding machine can comprise:

a core turret rotatable about a turret axis and provided with means for receiving a plurality of winding cores selectively positionable at a winding location and swingable along a swing circle away from and to the location:

a pair of rollers driven in opposite senses and engageable with a web to be wound on a winding core positioned at the location from opposite sides;

means for swinging the pair of rollers about a pivot axis common to the rollers and parallel to the turret axis to selectively position one and another of the rollers of the pair at the location in juxtaposition with an empty core for wrapping the empty core with the web in one or an opposite sense for selectively applying a surface of the web inwardly or outwardly to the empty core for correspondingly winding a roll of the web on the core; and swing arm means including at least one swing arm pivotable about a further axis parallel to the turret and the pivot axes and provided with cutter means for severing the web and at least one deflection roller engaging the web between the location and a wound roll on a core along the swing circle swung away from the location from a respective side of the web to apply a cut end of the web to the empty core.

Depending upon the direction of rotation of the contact roller which is swung into the winding location, the empty winding core brought into contact with that roller is driven to correspond to the feed of the web from the contact roller in the sense in which the web is to be wound upon the empty winding core.

According to one feature of the invention, the pair of oppositely driven rollers are symmetrically disposed at opposite ends of an arm which is rotated through 180° about the pivot axis for a change in the direction in which the core is to be wound with the web.

The swing arm means can include a pair of swing arms adapted to swing from opposite directions into engagement with the web and each of which carries a cutter for severing the web. Alternatively, a single swing arm may be selectively mounted to swing from one or another pivot on one or the other side of the winding core. In the latter case, a single blade may be used or two spaced apart cutter arrangements can be employed. The contact roller of the roller pair may be mounted on a carrier which can be shifted relative to the winding core or sleeve to enable the roll to grow as it is wound, the carrier being mounted on a slide and being provided with, for example, a controllable positioning unit such as a piston and cylinder arrangement. The slide or carrier can be provided with deflecting rollers or traction rollers for the web.

When, following a transverse severing of the web, a change in the direction in which the web is to be wrapped onto the winding sleeve or core is to be effected, the pair of rollers can be switched by angular displacement about the pivot axis to change the roller provided at the contact location for the roller rotating in the opposite sense. This switchover ensures that the contact roller will always be driven in the proper sense for the particular direction of application of the web to the winding core. The new empty winding core is then brought against the contact roller and driven in the new direction therewith. The respective swing arm or the single swing arm displaced in the respective direction then can be brought into play to sever the web from the completed roll carried away from the winding location and to apply the leading end of the web thus formed to the core in the new wrapping direction.

Instead of a pivot roller pair mounted to be diametrically opposite one another about the pivot axis which forms a common centerpoint and with respect to which the pair of rollers is swingable through 180° to substitute a roller driven in one sense by a roller driven in the opposite sense, the rollers can be mounted on a segment-like support which can be swung 90° in a clockwise and a counterclockwise sense to switchover the rollers driven in opposite senses.

The pivot roller pair can be mounted on a substantially Z-shaped pivot arm so that each roller of the pair can swing at the end of a respective link articulated to this arm. Respective fine adjustment units such as piston and cylinder units can be articulated to each link and to the arm to adjust the position of the contact roller with fine precision. The carriage on which the pivot arm is mounted, in turn, can be shifted relative to the winding location to provide the coarse adjustment, e.g. via another piston and cylinder unit.

The pivot arms swingable from above and below the winding core or sleeve may be generally C-shaped and proximal to their ends remote from the respective pivots, can be formed with deflection rollers. The cutter units may be blades swingable about the axis of one of the deflection rollers.

Alternatively, a single C-shaped swing arm may be provided and may, in the vicinity of its opposite ends be engageable by an automatic pivot bearing above and below the winding core to swing in one or the other direction selectively to deflect the web and cut the latter.

A central cutter may be provided if respective cutters swingable about axes of deflection rollers at the ends of the swing arm or swing arms is not employed. The transverse cutting unit can be provided with a straight or toothed swingable blade or a sickle or hook shaped blade on a slide which moves transverse to the winding core or a limitedly sectional transverse blade movable in a slide transverse to the web. With the machine of the invention, the direction in which the core is wrapped by the web can be changed without interrupting the winding process.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
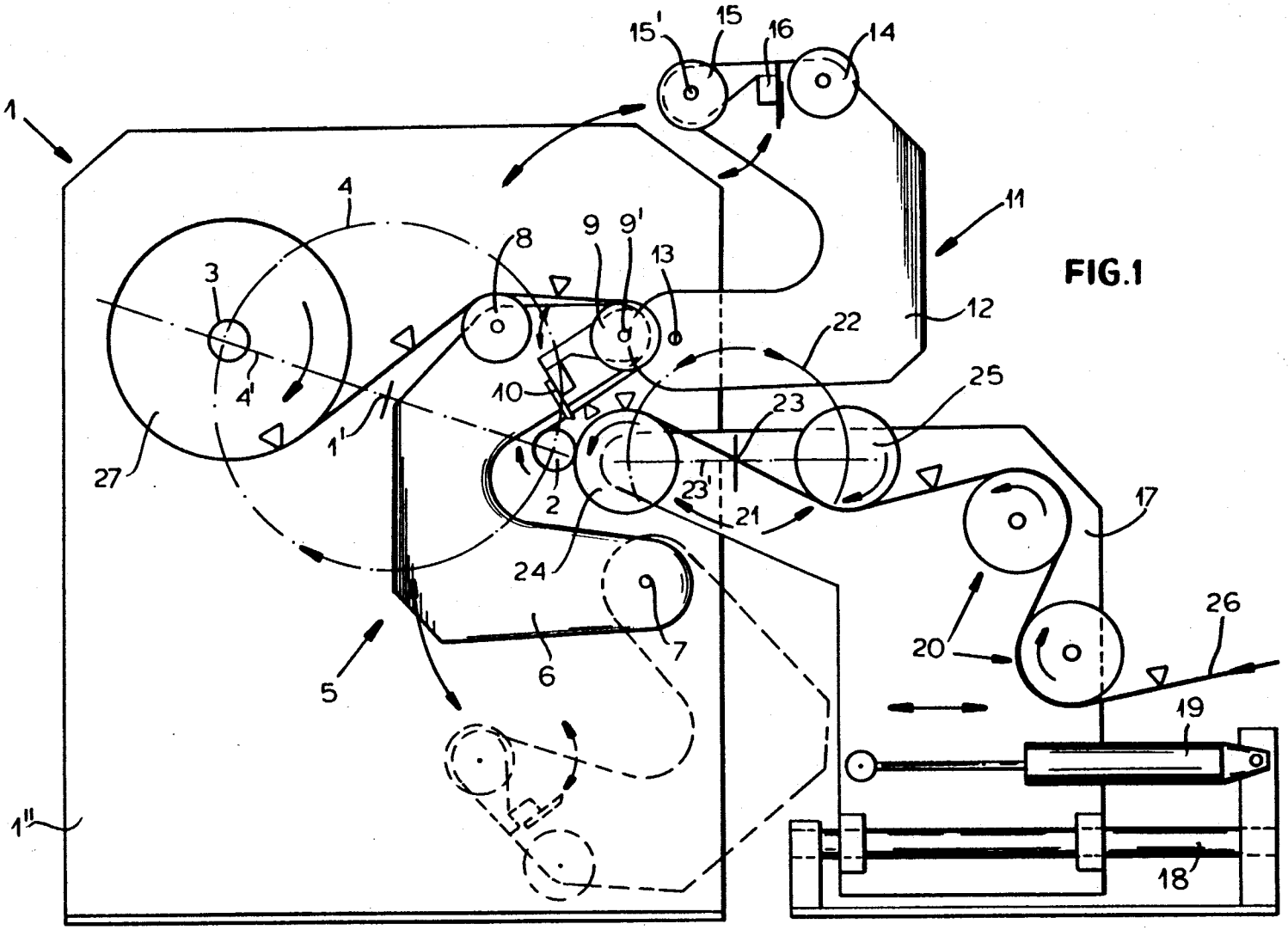
FIG. 1 is a front elevational view in highly diagrammatic form illustrating a first embodiment of the invention.

As will be apparent from FIG. 1, a multiple winding apparatus 1 comprises a machine frame 1" having two winding stations on a common turret and represented by the winding cores or sleeves 2, 3. The winding turret is centered on the swing circle 4 at 1' which represents the center of swing for the arms which carry the core holders not shown in the drawing. Turret winders in which two diametrically opposite cores or sleeves are carried upon a turret are disclosed, for example, in U.S. Pat. No. 3,478,975 and in EP-A2 0 132 390.

A first web separating device 5 is comprised of a swingable arm 6 whose pivot axis 7 lies below the coiling sleeve or core 2. The arm 6 is generally C-shaped and has at its side turned away from the pivot axis 7, two deflecting rollers 8 and 9. A blade unit 10 swingable about a pivot axis 9' corresponding to the center of the deflecting roller 9, is swingable on the arm 6.

A further web separating device 11 is comprised of a pivot arm 12 which is constructed like the pivot arm 6, is C-shaped and is swingable about the pivot axis 13 above the sleeve 2. The pivot arm 12 is also provided with deflecting rollers 14 and 15. About the pivot axis 15' of the deflecting roller 15, a separate transverse cutting blade unit 16 is swingable.

The multiple winding device 1 also comprises a carrier 17 which is displaceable toward and away from the machine frame 1" on a slide 18 via a controllable positioning unit 19 which may be a fluid operated cylinder. The carrier 17 serves to feed a web 26 to the winding device and comprises, for this purpose, deflecting rollers or a traction roller pair 20 as well as a pair of rollers 24 and 25 rotatable on a roller support represented at 23'. The roller support 23', with the rollers 24 and 25 thereon is swingable as represented by the swing circle 22 through 180° about the axis 23. They constitute a swing roller pair as represented at 21.

The rollers 24 and 25 have respective drives, not shown. In FIG. 1, the roller 24 serves as the so-called contact roller and is in contact with the coiling sleeve or core 2 to effect enveloping of the core with the web.

The multiple coiling device operates as follows.

In the coiling process the web 26 derives from a production machine or an uncoiling device of a rerolling machine and is supplied from the right hand side of the apparatus via the traction roll pair 20 and the swing roll pair 21 to a coiling location at which the winding sleeve or core 2 or 3 is disposed.

In the embodiment illustrated in FIG. 1, the web 26 can be considered to have a coated or printed surface represented by the symbol ∇.

When the desired roll diameter is reached on the core, the turret represented at 4' is swung about its axis 1' to swing the empty winding core 2 in the clockwise sense to the contact location against the roller 24 of the roller pair 21. The web 26, however, continues to wind onto the winding core 3 until a full roll 27 is formed.

To divide the web 26 and to cause it to envelope or wrap around the empty core 2, the lower severing device 5 is actuated to swing the arm 6 about the pivot axis 7 from its rest position shown in dot-dash lines, upwardly and in the clockwise sense. The rollers 9 and 8 then engage the web 6 (see the position shown in FIG. 1) and the blade unit 10 is actuated to swing in the counterclockwise sense about its axis 9' to separate the web around on the roll 27 from the oncoming web which is, by reason of its deflection by the rollers 8 and 9, wrapped around the core 2.

The severing unit 5 then swings back into its rest position, i.e. downwardly and in a counterclockwise sense, the rest position being indicated in dot-dash lines in FIG. 1.

The trailing end of the web 26 formed by the cutting operation of the blade unit 10, winds onto the roll 27 which is removed and replaced by a new empty core 3. The coated or printed side of the web 26, in this winding operation has its coated or printed side ∇ wound inwardly upon the core or sleeve 2 and in the roll 27. The coiling operation is repeated until it is required to form rolls 27 with the coating side outwardly. During these operations, therefore, the upper cutting unit 11 remains in its rest position, unactuated, as shown in solid lines in FIG. 1.

When it is required to apply the web 26 to the winding core or sleeve 2 so that the coated side ∇ is turned outwardly (FIG. 2) the swing roller pair 21 is caused to pivot in the counterclockwise sense through 180° about the pivot axis 23, thereby positioning the roller 25 as the contact roller. The web 26 now passes automatically over the roller 24 and under the roller 25. During this swinging movement of the roller pair 21, the direction of rotation of the winding core or sleeve 2 is reversed so that it is rotated in the counterclockwise sense, either by contact with the roller 25 which is driven in the clockwise sense or by a separate drive.

Figure 2:
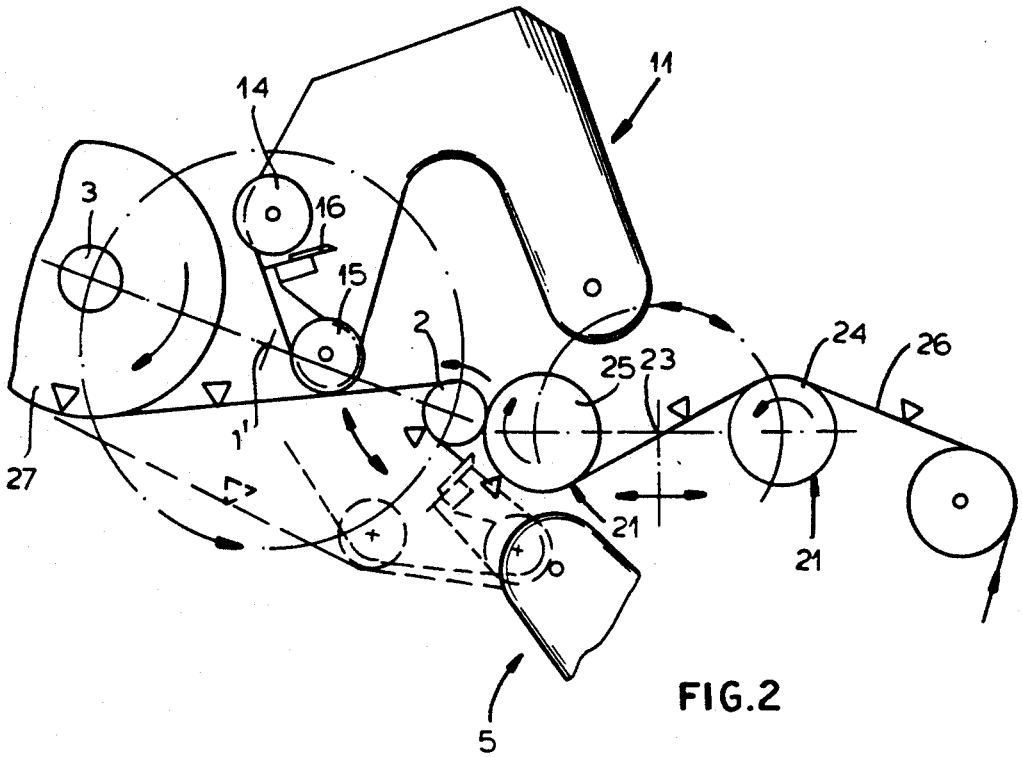
FIGS. 2 and 3 are diagrams showing other positions of this embodiment.

The upper cutting device 11 is swung from its rest position shown in FIG. 1 in the counterclockwise sense through the position shown in FIG. 2 while the lower cutting unit 5 remains in its rest position 5 shown in dot-dash lines in FIG. 1.

As the cutting unit 11 continues its movement (FIG. 2) the unit 11 assumes the broken line position seen in FIG. 2 in which the rollers 14 and 15 deflect the web 26 and the cutter 16 can be actuated to sever the web and cause the trailing end to wind on the roll 27 while the oncoming end winds on the roll core 2. The cutting unit 11 then swings in the clockwise sense back into its starting position and the roll 27 is wound on the core 2 with the coated side ∇ of the web turned outwardly. The completion of this operation is represented in FIG. 3 from which it can be seen that the roller pair 21 remains in position.

Figure 3:
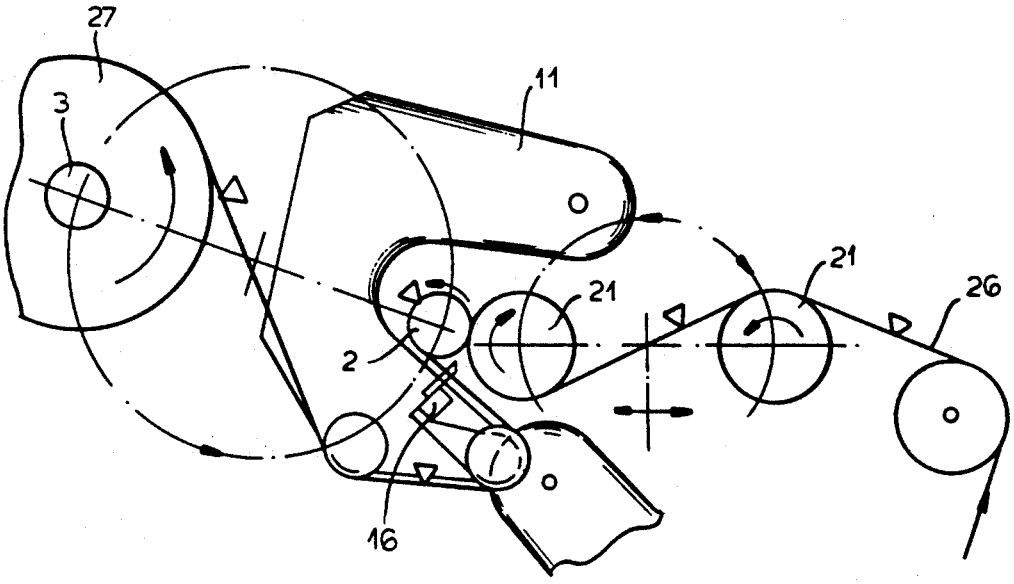

Upon completion of the winding of a roll 27, the turret is rotated so that the new core 2 is brought into position while the wound core is at the location of the core 3 in FIG. 3. As the cutting unit 11 is now swung in the counterclockwise sense again, its cutter can sever the web 26 and the process can be repeated for as long as rolls 27 are to be fabricated with the coated side ∇ turned outwardly. The blade units 10 and 16 can be constructed in accordance with the material to be cut and can be differently or variously formed with, for example, blast nozzles or tubes, holders against which the web is sheared, or the like.

If the direction in which the core 2 is to be wrapped is to be changed again, the swing roller pair 21 is returned in the opposite sense through 180° whereupon the web 26 again passes under the roller 25 and over the roller 24. As can be seen from FIG. 1, the empty roll core 2 is swung against the roller 24 and is driven in the clockwise sense with the winding of the rolls 27 being separated by the cutting unit 25 so that the coated side ∇ is again turned inwardly.

Figure 4:
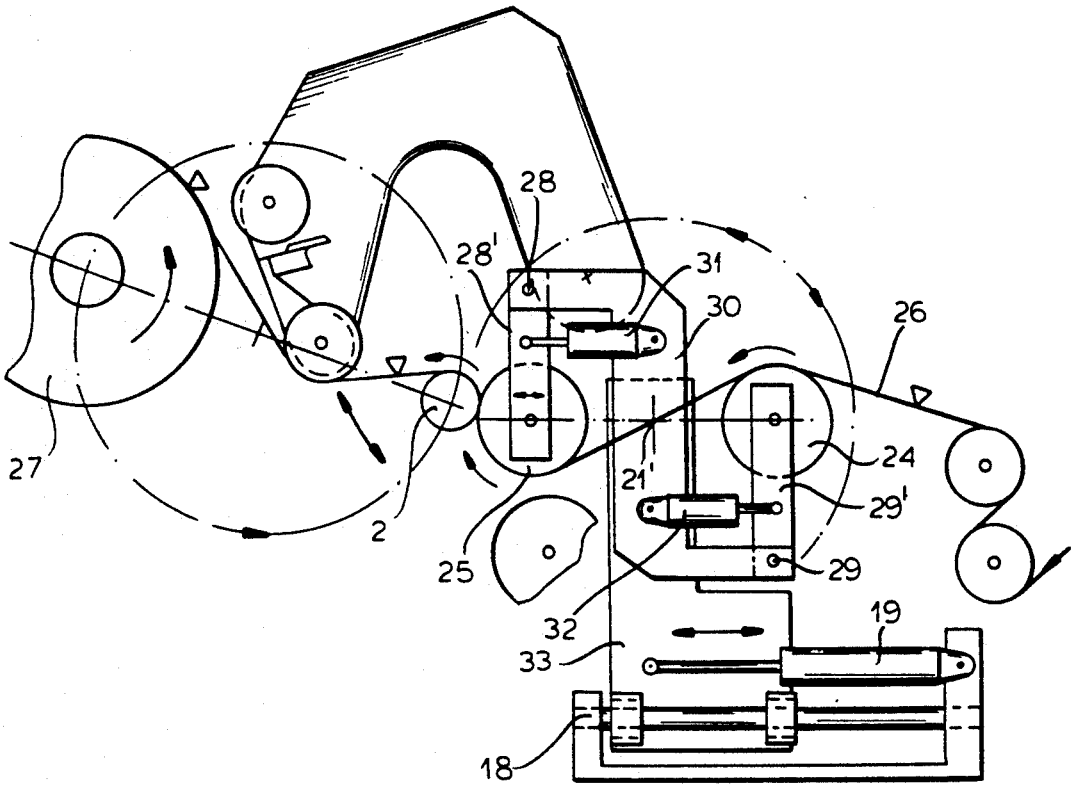
FIG. 4 is a view similar to FIG. 1 illustrating another embodiment with a modified feed of the web and mounting of the swingable roller pair.

FIG. 4 shows a modification of the swing roller pair 21. In this case, the rollers 24 and 25 are individually swingable at 28 and 29 on the pivot arm 30 which is rotatable about the pivot axis 21' at respective pivots. The rollers 24 and 25 are carried by the respective arms 28' and 29' which themselves are controlled by respective fluid cylinders 31 and 32 articulated on the arm 30. These piston and cylinder units 31 and 32 can allow the contact roller 24 or 25 to be pressed with great sensitivity against the winding core 2 or the roll 27 which is wound thereon.

The swing arm 30 is removably mounted and replaceable on a support 33 which is mounted, in turn, upon the slide 18 and can be advanced and retracted by the positioning piston and cylinder unit 19 allowing coarse adjustment of the contact between the contact roller 24 or 25 and the winding core 2 or the roll 27.

Figure 5:
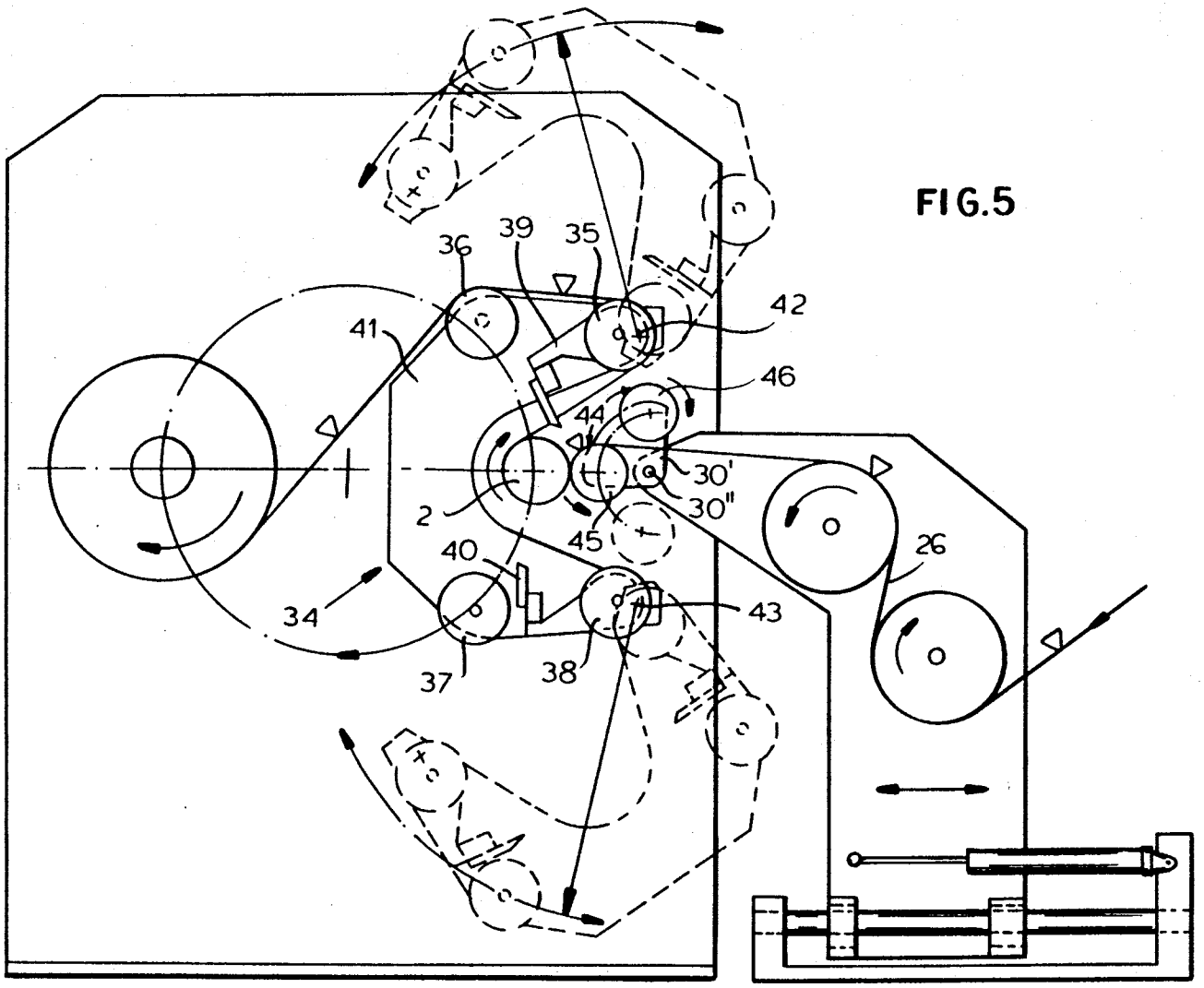
FIG. 5 is another view similar to FIG. 1 showing another arrangement of a swingable roll pair and a single swing arm which can be selectively pivoted from locations above and below the winding core.

A further embodiment is shown in FIG. 5 wherein a web cutting unit 34 has a C-shaped swingable arm 41 common to both cutters 39 and 40 and provided with four deflecting rollers 35, 36, 37 and 38. The cutters 39 and 40 are swingable about the axes of the deflecting rollers 35 and 38.

The swing arm 41 has two swing bearings 42 and 43 which are selectively used and automatically coupled to the arm 41 so that the arm 41 can swing alternatively about the bearing 42 or the bearing 43 and can, in this manner, be disposed above the core or sleeve 2 (swinging in the bearing 42) or below the core or sleeve 2 (swinging in the bearing 43) depending upon the direction in which the arm 41 is swung, the web can be cut and deflected to wind around the core 2 in one direction or the other direction as has been described in connection with FIGS. 1 and 2 for example.

FIG. 5 also shows an alternative for the swing roller pair 21 which was described in connection with FIGS. 1 and 2. Here the swing roller pair 44 comprises two rollers 45 and 46 which are carried about an arm 30' pivotable about an axis 30" through 90° from the solid line position shown in FIG. 5 to the broken line position shown.

Figure 6:
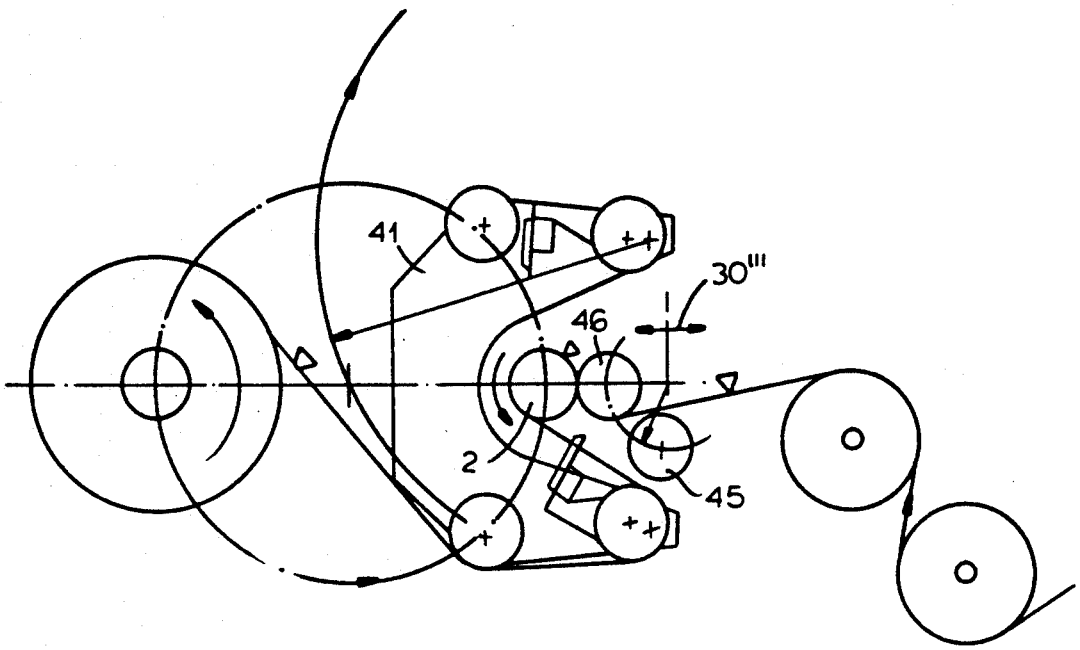
FIG. 6 is a diagram showing another separating and applicator device for applying the web to a core utilizing two bearing locations for the swing arm.

For a wrapping of the core 2 so that the coated or printed surface ∇ of the web 26 lies inwardly, the roller pair 45, 46 will assume the solid line position illustrated in FIG. 5 and an upward swing of the arm 41 about the lower bearing 43 will be used to sever the web upon the completion of each roll. When, however, it is desirable to wind the web 26 so that its coated surface or printed surface ∇ is turned outwardly, the roller pair 44 is swung through 90° in the counterclockwise sense from the position shown in FIG. 5 to the position shown in FIG. 6 wherein the roller 46 becomes the contact roller. The arm 41 is then swung downwardly about the pivot or bearing 42 for the winding of the core 2 in the opposite sense.

Figure 7:
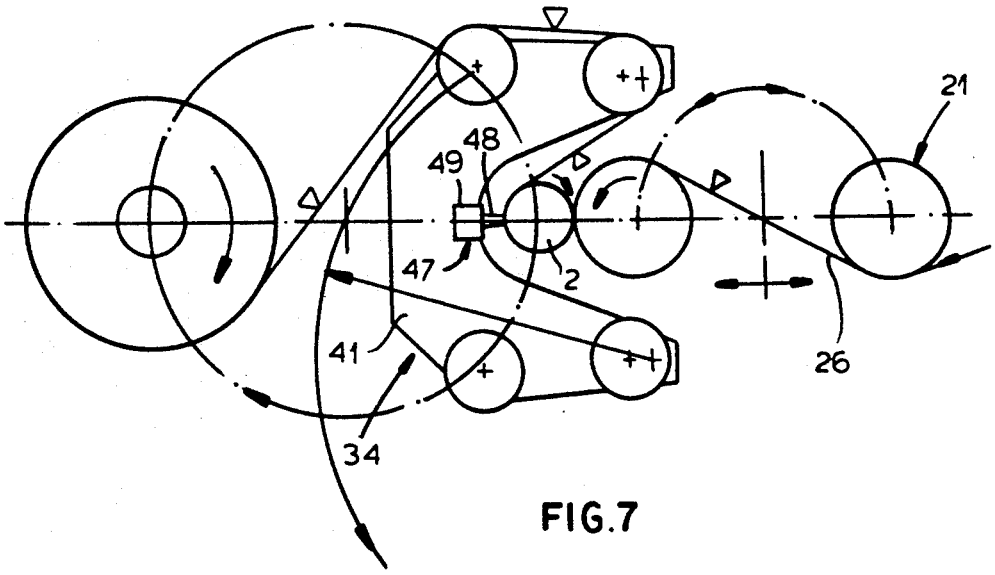
FIG. 7 is a similar view showing the swing arm provided with a single cutting unit for severing the web.

FIG. 7 shows a further embodiment in which the web cutter 34 is provided with only a single blade unit 47 which can comprise a cutting blade 48 directly juxtaposed with the core or sleeve 2 and displaceable toward and away from the latter by a slidable member 49 to cut the web perpendicular to the latter and against the core or sleeve 2. In this embodiment, the coating side ∇ is shown as it is coiled inwardly and the pivot arm 41 as coupled with the pivot bearing 43. Of course, with reversal of the swing roller pair 21, the coating side can be applied to the core outwardly utilizing the principles described above.

The invention is not limited to the embodiments described but may be modified within the scope of the appended claims so that on the swing arms 6, 11, 41, straight or toothed swingable cutting blades can be used or sickle or hook shaped blades on slides transverse to the winding core or the cutting units can be limitedly swingable cutting blades in guides which are movable transversely to the web.

I claim:

1. A winding machine, comprising:

a core turret rotatable about a turret axis and provided with means for receiving a plurality of winding cores selectively positionable at a winding location and swingable along a swing circle away from and to said location;

a pair of roll-contact rollers driven in opposite senses and engageable selectively with opposite sides of a web to be wound on a winding core positioned at said location;

means for swinging said pair of rollers about a pivot axis common to said rollers and parallel to the turret axis to selectively position one and another of the rollers of said pair at said location in juxtaposition with an empty core and in contact with a roll wound thereon for wrapping said empty core with said web in one or an opposite sense for selectively applying a surface or said web inwardly or outwardly to said empty core for correspondingly winding a roll of said web on said core; and swing arm means including at least one swing arm pivotable about a further axis parallel to said turret and said pivot axes and provided with cutter means for severing said web and at least one deflection roller engaging said web between said location and a wound roll along said swing circle swung away from said location from a respective side of said web to apply a cut end of said web to said empty core.

2. The winding machine defined in claim 1 wherein said pair of rollers is mounted symmetrically with respect to said pivot axis for swinging through 180° for selectively positioning one or another of the rollers of said pair at said location.

3. The winding machine defined in claim 1 wherein said pair of rollers is mounted on a carrier shiftable on a slide, further comprising positioning means for shifting said carrier relative to said location.

4. The winding machine defined in claim 3 wherein said rollers are mounted on a swingable support on said carrier.

5. The winding machine defined in claim 1 wherein said rollers are mounted on a segmental plate swingable about said pivot axis through 90° in one sense and in an opposite sense, said pivot axis lying in a plane common to said roller positioned at said location, to an axis of said empty core and to said turret axis, said pivot axis being shiftable relative to said location in said plane.

6. The winding machine defined in claim 1 wherein said swing arm means includes respective swing arms pivotal about respective axes above and below said web at said location, each carrying a pair of deflection rollers and having a respective cutter swingable about the axis of a respective one of said rollers to sever said web.

7. The winding machine defined in claim 1 wherein said swing arm is selectively swingable about axes disposed above and below said web at said location.

8. The winding machine defined in claim 7 wherein said swing arm carries a pair of cutters each engageable with said web upon swinging of said swing arm against said web from a respective side of said web.

9. A winding machine, comprising:

a core turret rotatable about a turret axis and provided with means for receiving a plurality of winding cores selectively positionable at a winding location and swingable along a swing circle away from and to said location;

a pair of roll-contact rollers driven in opposite senses and engageable selectively with opposite sides of a web to be wound on a winding core positioned at said location from opposite sides;

means for swinging said pair of rollers about a pivot axis common to said rollers and parallel to the turret axis to selectively position one and another of the rollers of said pair at said location in juxtaposition with an empty core and in contact with a roll wound thereon for wrapping said empty core with said web in one or an opposite sense for selectively applying a surface or said web inwardly or outwardly to said empty core for correspondingly winding a roll of said web on said core; and swing arm means including at least one swing arm pivotable about a further axis parallel to said turret and said pivot axes and provided with cutter means for severing said web and at least one deflection roller engaging said web between said location and a wound roll on a core along said swing circle swung away from said location from a respective side of said web to apply a cut end of said web to said empty core, said pair of rollers being mounted on a carrier shiftable on a slide; and positioning means for shifting said carrier relative to said location, said rollers being mounted on a swingable support on said carrier, said support being a substantially Z-shaped swing arm and said rollers are mounted on links pivotally connected to said swing arm and displaceable relative to said swing arm by respective cylinder and piston units.

10. A winding machine, comprising:

a core turret rotatable about a turret axis and provided with means for receiving a plurality of winding cores selectively positionable at a winding location and swingable along a swing circle away from and to said location;

a pair of roll-contact rollers driven in opposite senses and engageable selectively with opposite sides of a web to be wound on a winding core positioned at said location from opposite sides;

means for swinging said pair of rollers about a pivot axis common to said rollers and parallel to the turret axis to selectively position one and another of the rollers of said pair at said location in juxtaposition with an empty core and in contact with a roll wound thereon for wrapping said empty core with said web in one or an opposite sense for selectively applying a surface or said web inwardly or outwardly to said empty core for correspondingly winding a roll of said web on said core; and swing arm means including at least one swing arm pivotable about a further axis parallel to said turret and said pivot axes and provided with cutter means for severing said web and at least one deflection roller engaging said web between said location and a wound roll on a core along said swing circle swung away from said location from a respective side of said web to apply a cut end of said web to said empty core, said swing arm being selectively swingable about axes disposed above and below said web at said location, said swing arm carrying a pair of cutters each engageable with said web upon swinging of said swing arm against said web from a respective side of said web and to a single cutter on said swing arm shiftable toward said empty core for severing said web thereagainst.

* * * * *